US005836127A

United States Patent [19]

Clark et al.

[11] Patent Number: 5,836,127

[45] Date of Patent: Nov. 17, 1998

[54] SYSTEM AND METHOD FOR INSTALLING CEILING PANELS

[76] Inventors: Delbert M. Clark; Jerry L. Trunkenbolz, both of 12704 E. Nora Ave., Spokane, Wash. 99216

[21] Appl. No.: 891,473

[22] Filed: Jul. 11, 1997

[51] Int. Cl.[6] ..... E04B 9/06

[52] U.S. Cl. ..... 52/506.07; 52/287.1; 52/311.1; 52/718.01; 52/718.04; 52/745.13

[58] Field of Search ..... 52/506.07, DIG. 4, 52/DIG. 8, 718.01, 718.04, 656.1, 311.3, 311.1, 287.1, 745.13

[56] References Cited

U.S. PATENT DOCUMENTS

| | | | |
|---|---|---|---|
| 3,546,842 | 12/1970 | Blum | 52/DIG. 8 X |
| 4,742,662 | 5/1988 | Smith | 52/DIG. 8 X |
| 4,747,246 | 5/1988 | Sanborn | 52/506.07 |
| 4,848,054 | 7/1989 | Blitzer et al. | 52/DIG. 8 X |
| 5,265,393 | 11/1993 | Bischel et al. | 52/DIG. 8 X |
| 5,414,969 | 5/1995 | Krejci et al. | 52/503.07 X |

*Primary Examiner*—Christopher Kent
*Attorney, Agent, or Firm*—Grimes & Battersby

[57] ABSTRACT

A T-Bar grid system is provided for installing ceiling panels particularly natural wood ceiling panes. The grid system includes a plurality of downwardly hanging T-Bars for supporting the ceiling panels. Each of the T-Bars includes at least one exposed lower surface. The grid system further includes a plurality of grid covers adapted to be releaseably secured to and cover the exposed lower surfaces of the T-Bars. The grid covers are formed from a material generally compatible with the ceiling panels, typically wood or a comparable thermoplastic material. Releasable securing means are affixed to a center recess within the grid covers and allow the grid cover to be releaseably secured to the exposed lower surface of the T-Bars. The releasable securing devices can constitute a magnetic securing device or, alternatively, a spring clip. A method is further provided for installing such natural wood ceiling panels by releaseably securing said grid covers to the exposed lower surfaces of the T-Bar after insertion of the ceiling panels.

14 Claims, 2 Drawing Sheets

SYSTEM AND METHOD FOR INSTALLING CEILING PANELS

BACKGROUND OF THE INVENTION

1. Field of the Invention

The present invention relates generally to a system and method for installing ceiling panels and, more particularly, to such a system and method which is particularly adapted to be used for installing natural wood ceiling panels using a traditional T-Bar grid system of the type used to install traditional acoustical tile suspended ceilings. Specifically, the invention comprises a T-Bar grid system, which includes a plurality of grid covers adapted to be releaseably secured to the exposed lower surfaces of the T-Bar grids. These grid covers are of a style and type compatible with the natural wood ceiling panels being installed and are releaseably secured to the exposed lower surface of the T-Bar grid system by magnets or clips.

2. Description of the Prior Art

The use of T-Bar grid systems for supporting a suspended acoustical tile ceiling is well known and has been universally used for many years both in residential and commercial applications. Such T-Bar grid systems have, heretofore, been marketed by the manufacturers of acoustical ceiling tiles and panels such as, for example, Armstrong, USG and others for use in the installation of their ceiling tiles and panels. Users have long accepted the painted metal surfaces of the exposed lower surface of the T-Bar grid systems between the ceiling tiles and panels, principally because they are normally used in conjunction with white or off-white acoustical ceiling tiles.

Similar T-Bar grid systems have been used for installing natural wood ceiling tiles or panels and these natural wood ceiling tiles and panels are installed in much the same manner as acoustical ceiling tiles. The problem presented, however, is that the white metal surfaces of the visible portion of the T-Bar grid system between the natural wood ceiling panels are not aesthetically appealing because of their contrast with the wood ceiling panels. To minimize this contrast, some installers have actually painted the exposed lower surfaces of the T-Bar grid system or have used darker colored T-Bar grid systems to better blend the exposed lower surfaces with the wood ceiling panels. While somewhat minimizing the problem, it has not eliminated it entirely because the difference in materials, i.e., wood versus metal, still renders the combination aesthetically unappealing.

SUMMARY OF THE INVENTION

Against the foregoing background, it is a primary object of the present invention to provide a T-Bar grid system that may be used to install natural wood ceiling tiles or panels.

It is another object of the present invention to provide such a T-Bar grid system in which the exposed lower surfaces of the T-Bar grid system between the wood ceiling panels are covered with a grid cover fabricated from wood or plastic.

It is yet another object of the present invention to provide such a T-Bar grid system in which the grid covers are secured to the exposed lower surfaces of the T-Bar grid system by magnets or clips.

It is still another object of the present invention to provide such a T-Bar grid system in which such grid covers are releaseably secured to the exposed lower surfaces of the T-Bar grid system.

It is yet still another object of the present invention to provide a method for installing a suspended ceiling of natural wood ceiling panels.

It is still yet another object of the present invention to provide such a method for installing a suspended ceiling by suspending such natural wood ceiling panels from a T-Bar grid system.

It is but yet another object of the present invention to provide such a method for installing such a suspended ceiling which further includes the step of releaseably securing wood or plastic grid covers over all of the exposed lower surfaces of said T-Bar grid system.

To the accomplishments of the foregoing objects and advantages, the present invention, in brief summary, comprises a T-Bar grid system for installing ceiling panels, particularly natural wood ceiling panes. The grid system includes a plurality of downwardly hanging T-Bar grids for supporting the ceiling panels each having an exposed lower surface and a plurality of grid covers adapted to be releaseably secured to and cover said exposed lower surfaces. The grid covers are formed from a material generally compatible with the ceiling panels, typically wood or a comparable thermoplastic material. Releasable securing means are affixed to a center recess within the grid covers for releaseably securing the grid cover to the exposed lower surface of the T-Bar grid. The releasable securing devices can constitute a magnetic securing device or, alternatively, a spring clip.

A method is further provided for installing such natural wood ceiling panels by releaseably securing said grid covers to the exposed lower surfaces of the T-Bar grid after insertion of the ceiling panels.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

BRIEF DESCRIPTION OF THE PREFERRED EMBODIMENTS

Figure 1:
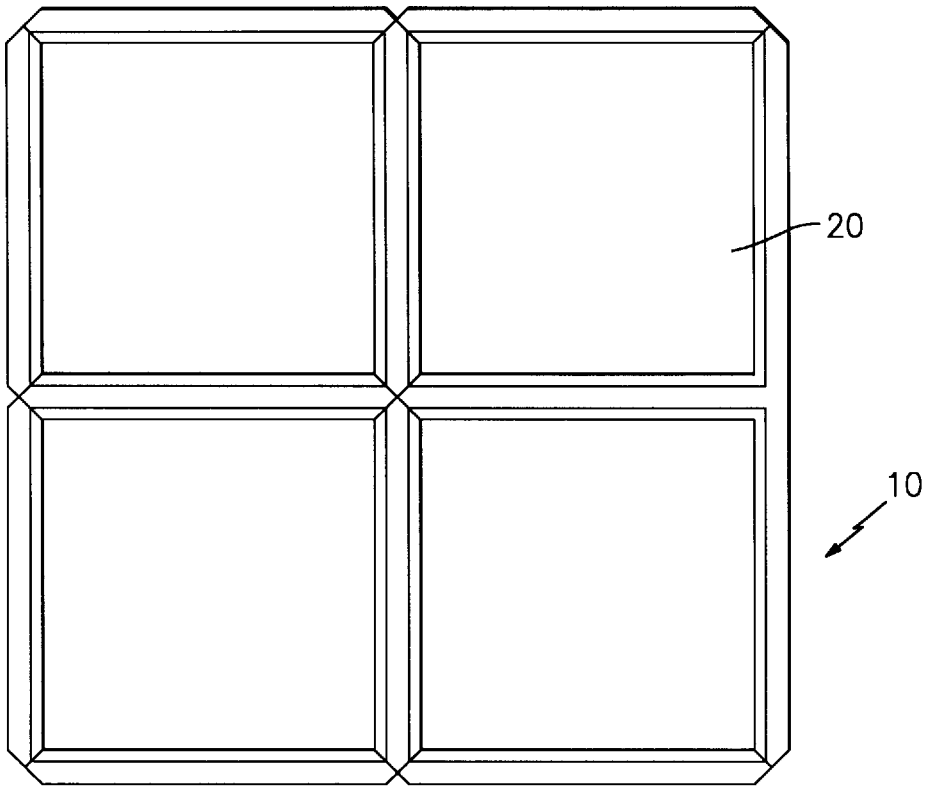
FIG. 1 is a bottom view of the T-Bar grid system of the present invention illustrating the manner in which wood ceiling tiles can be installed.
Figure 2:
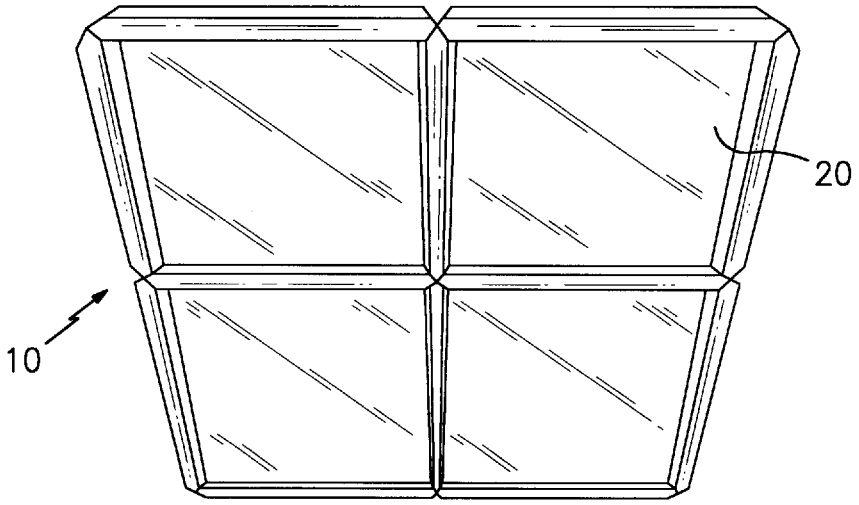
FIG. 2 is a perspective view of the T-Bar grid system of FIG. 1.

Referring to the drawings and, in particular, to FIGS. 1 and 2 thereof, the T-Bar grid system of the present invention referred to generally by reference numeral 10 is illustrated. T-Bar grid system 10 is a conventional T-Bar grid system of the type heretofore used to install acoustical ceiling tiles. FIGS. 1 and 2, however, illustrate its use in installing natural wood ceiling tiles 20 either in sections (as shown in these FIGS.) or, alternatively, over the entire expanse of the ceiling.

As one can readily appreciate, when these natural wood ceiling tiles 20 are installed in the T-Bar grid system 10 of the present invention, there is a marked contrast in color and texture between the exposed lower surface of the metal grid which is typically painted white and the natural wood ceiling panel 20.

In order to eliminate this contrast, one or more grid covers 30 are provided which are adapted to be releaseably secured to the exposed lower portion 40 of the T-Bars 50. Grid covers 30 may be fabricated from wood or a thermoplastic material of a color and texture to match that of the natural wood ceiling panel 20. It will be appreciated that the length and width as well as the number of the grid covers 30 are all selected to conform to the exposed lower portions 40 of the T-Bars of the T-Bar grid system 10 of the present invention. Typical lengths of the grid covers 30 are between two and four feet in length to conform to the typical dimensions of ceiling tiles or panels, whether acoustical or natural wood panels. The ends of the grid covers 30 can be squared or tapered depending upon the user's preference.

Figure 3:
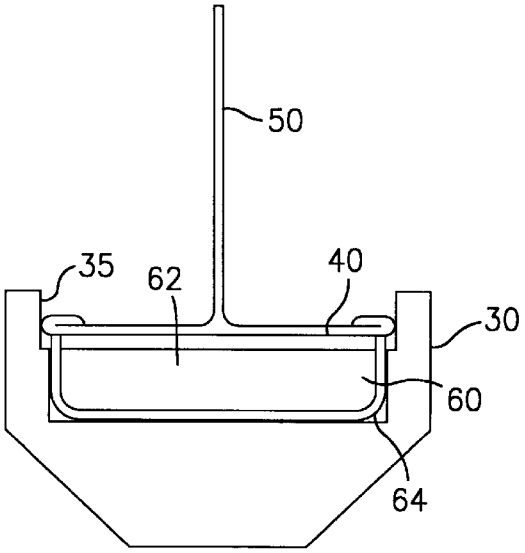
FIG. 3 is an enlarged sectional view of the T-Bar grid system of FIG. 1.
Figure 4:
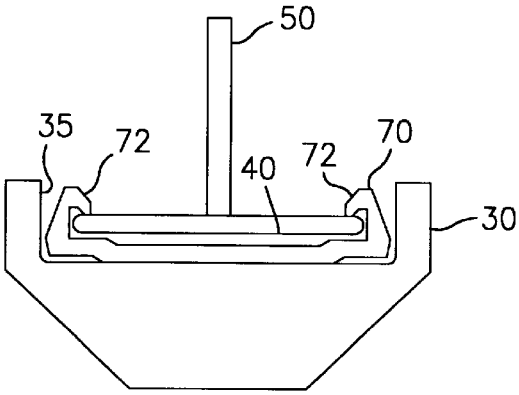
FIG. 4 is an enlarged end view of an alternative embodiment of the T-Bar grid system of the present invention.

Grid covers 30 are preferably attached to the exposed lower portions 40 of the T-Bars 50 by magnetic securing devices (as shown in FIG. 3) or by metal or plastic clips as shown in FIG. 4. In the embodiment of FIG. 3, the magnetic securing device 60 includes a conventional magnet 62 which is contained in a metal saddle 64 which is secured to a center recess 35 formed in the grid cover 30. The magnetic securing device 60 may be affixed to the grid cover 30 by a compression fit as shown in FIG. 3 or, alternatively with the use of an adhesive material. Similarly, the magnetic securing device 60 may be physically affixed to the grid cover 30 using screws or other conventional physical securing means (not shown). It will be appreciated that the magnetic securing devices 60 are spaced along the recess contained within the grid cover 30 to provide a plurality of attachment points for the grid cover 30 to the exposed lower surfaces 40 of the T-Bar 50.

By releaseably securing the grid cover 30 to the exposed lower surface T-Bar grid, the installer is able to quickly and inexpensively install the grid cover 30 to the T-Bar grid system of the present invention. Moreover, in the event that the user elects to change the wooden ceiling panels 20 to another type of ceiling tiles or panels, the grid covers 30 can be easily removed and replaced with different grid covers that are more suitably matched to the new ceiling tiles or panels.

As previously noted, the grid covers 30 can also be releasably secured to the exposed lower surface 40 of the T-Bars 50 through the use of a metal or plastic spring clip 70 as shown in FIG. 4. Spring clip 70 is affixed to the grid cover 30 within the center recess 35 contained therein. Spring clip 70 may be affixed to the grid cover 30 using an adhesive material or, alternatively, by physical attachment means (not shown). Upwardly extending opposed ends 72 of the spring clip 70 are adapted to engage the ends of the T-Bars 50.

Figure 5A:
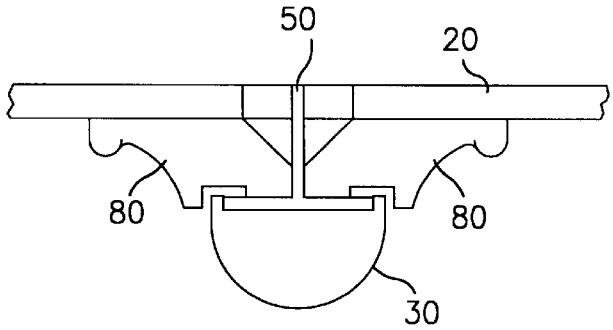
FIG. 5A is an end view of the T-Bar grid system of FIG. 1.
Figure 5B:
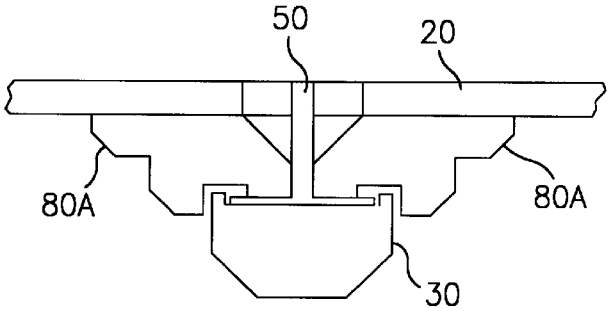
FIG. 5B is an end view of a further version of the alternative embodiment of FIG. 1.

FIGS. 5A and 5B illustrate alternative configurations for the grid cover 30 in a semicircular configuration in FIG. 5A and an octagonal configuration in FIG. 5B. In addition, FIGS. 5A and 5B illustrate the inclusion of molding 80 and 80A, respectively, which is adapted to engage both the upper portion of the T-Bars 50 and the underside of the wooden ceiling panel 20 to allow for full coverage of all exposed metal surfaces of the T-Bars.

It will be appreciated that the installation of a suspended ceiling with natural wood ceiling panels 20 can be accomplished using a conventional T-Bar grid system in the following manner. The installer first installs a conventional T-Bar grid system 10 and, upon installation thereof, then begins to insert the natural wood ceiling panels 20 in the appropriate portions thereof to be supported by the downwardly extending T-Bars 50. Grid covers 30 are then releaseably mounted over the exposed lower surfaces of the T-Bars 50. Molding 80 may also be utilized to provide a more aesthetically pleasing system.

Having thus described the invention with particular reference to the preferred forms thereof, it will be obvious that various changes and modifications can be made therein without departing from the spirit and scope of the present invention as defined by the appended claims.

Wherefore we claim:

1. A ceiling system including:

a plurality of downwardly hanging T-Bars forming a T-Bar grid system, each of said T-Bars having an upper surface and an exposed lower surface and adapted to support at least one ceiling panel;

a plurality of ceiling panels supported by said T-Bars;

a plurality of grid covers releasably secured to and covering the exposed lower surfaces of said T-Bars, and a plurality of pieces of molding which are each mounted between said grid covers and said ceiling panels, wherein each of said pieces of moulding are supported by the upper surface of said T-Bar and said ceiling panels.

2. The T-Bar grid system of claim 1, wherein said T-Bars are formed from a metallic material and wherein said grid covers are releaseably secured to the exposed lower surfaces of said T-Bars by magnetic securing means.

3. The T-Bar grid system of claim 2, wherein said magnetic securing means comprises a magnet mounted within a magnet sleeve which is fixedly secured to said grid cover.

4. The T-Bar grid system of claim 3, wherein said magnetic securing means is adhesively bonded to said grid cover.

5. The T-Bar grid system of claim 3, wherein said grid covers each include a center recess in which said magnetic securing means is secured.

6. The T-Bar grid system of claim 1, wherein said grid covers each include spring clips for releaseably securing said grid covers to said exposed lower surfaces of said T-Bar.

7. The T-Bar grid system of claim 1, wherein said ceiling panels are natural wood ceiling panels and wherein said grid covers are formed from a material selected from the group consisting of wood and a thermoplastic material.

8. A ceiling system including:

a plurality of downwardly hanging T-Bars forming a T-Bar grid system; and for supporting said ceiling panels, each of said T-Bars having an upper surface and an exposed lower surface;

a plurality of ceiling panels supported by said T-Bars;

a plurality of grid covers releaseably secured to and covering the exposed lower surfaces of said T-Bars, wherein said grid covers are formed from a material selected from the group consisting of wood and a thermoplastic material, and, further, wherein each of said grid covers includes at least one securing means adapted to releaseably secure said grid cover to the exposed lower surface of said T-Bars; and a plurality of pieces of molding which are each mounted between said grid covers and said ceiling panels and supported by the upper surface of said T-Bar and said ceiling panels.

9. The T-Bar grid system of claim 8, wherein said T-Bars are formed from a metallic material and wherein said grid covers are releaseably secured to said exposed lower surfaces of said T-Bars by magnetic securing means which comprises a magnet mounted within a magnet sleeve which is fixedly secured to said grid cover.

10. The T-Bar grid system of claim 8, wherein said grid covers each include spring clips for releaseably securing said grid covers to exposed lower surfaces of said T-Bars.

11. A ceiling system assembly kit for installing wood ceiling panels, said assembly kit including:

a plurality of downwardly hanging metallic T-Bars for forming a T-Bar grid system and for supporting said ceiling panels, each of said T-Bars including an upper surface and an exposed lower surface;

a plurality of ceiling panels;

a plurality of grid covers adapted to be releaseably secured to and cover the exposed lower surfaces of said T-Bars, said grid covers being formed from a material selected from the group consisting of wood and a thermoplastic material, wherein each of said grid covers includes at least one magnetic securing device consisting of a magnet mounted within a magnet sleeve which is fixedly secured to said grid cover for releaseably securing said grid covers to said exposed lower surfaces of said T-Bars; and a plurality of pieces of molding which are each adapted to be mounted between said grid covers and said ceiling panels wherein each of said pieces of molding are adapted to be supported by the upper surface of said T-Bar and said ceiling panels.

12. A method for installing ceiling panels using a T-Bar grid system, said method comprising the steps of:

erecting a T-Bar grid system of the type which includes a plurality of downwardly hanging T-Bars, each having an upper surface and an exposed lower surface;

installing at least one ceiling tile into said T-Bar grid system in which said downwardly hanging T-Bars serve to support said at least one ceiling tile;

providing a plurality of grid covers having releasable securing means for securing said grid covers to the exposed lower surface of said T-Bars;

providing a plurality of pieces of molding which are each adapted to be mounted between said grid covers and said ceiling panels;

releaseably securing said grid covers to the exposed lower surfaces of said T-Bars using said releasable securing means; and positioning at least one of said pieces of molding between the upper surface of at least one of said T-Bars and at least one of said ceiling panels.

13. The method of claim 12, wherein said grid covers are releasably secured to the T-Bars by magnetic securing means.

14. The method of claim 12, wherein said grid covers are releaseably secured to said T-Bars by spring clips.

* * * * *